US006036331A

United States Patent [19]

Acquisto

[11] Patent Number: 6,036,331

[45] Date of Patent: Mar. 14, 2000

[54] CEILING FAN WITH LIGHTED BLADES

[76] Inventor: Sam T. Acquisto, 108 Drive C., Garden Park Homes, Hazlet, N.J. 07730

[21] Appl. No.: 09/379,504

[22] Filed: Aug. 24, 1999

Related U.S. Application Data

[60] Provisional application No. 60/130,094, Apr. 20, 1999.

[51] Int. Cl.[7] ..... F21V 33/00

[52] U.S. Cl. ..... 362/96; 362/234; 416/5

[58] Field of Search ..... 362/234, 500, 362/294, 96; 416/5

[56] References Cited

U.S. PATENT DOCUMENTS

| | | | |
|---|---|---|---|
| 3,174,552 | 3/1965 | Soucy, Jr. | 362/464 |
| 3,701,498 | 10/1972 | Ferrara | 244/17.11 |
| 3,723,722 | 3/1973 | Van Iderstine et al. | 362/470 |
| 4,881,153 | 11/1989 | Scott | 362/500 |
| 5,028,206 | 7/1991 | Kendregan et al. | 416/5 |
| 5,072,341 | 12/1991 | Huang | 362/96 |
| 5,082,422 | 1/1992 | Wang | 416/5 |
| 5,437,540 | 8/1995 | Blocker et al. | 416/5 |
| 5,810,450 | 9/1998 | Tsu | 362/500 |
| 5,876,108 | 3/1999 | Chien | 362/500 |

*Primary Examiner*—Sandra O'Shea
*Assistant Examiner*—Hargobind S. Sawhney
*Attorney, Agent, or Firm*—Richard C. Litman

[57] ABSTRACT

A ceiling fan having illumination sources that are mounted to the fan blades is disclosed. Each fan blade has a lighting strip with a plurality of light sources along its length provided along the midline of each blade. Two sets of concentric races having rolling bodies therebetween provide the conductive connection between the rotating illumination sources and the stationary electrical power supply wires. Each set of concentric races includes an inner stationary race and an outer rotating race. The lights attached to the fan blades are connected in parallel to the outer rotating races. Separate switches control the fan and lighting functions.

9 Claims, 3 Drawing Sheets

CEILING FAN WITH LIGHTED BLADES

CROSS-REFERENCE TO RELATED APPLICATION

This application claims the benefit of U.S. Provisional Patent Application Ser. No. 60/130,094, filed Apr. 20, 1999.

BACKGROUND OF THE INVENTION

1. Field of the Invention

The present invention relates to a ceiling fan having lights incorporated in the fan blades.

2. Description of Related Art

Ceiling fans are widely used household fixtures. Not only do ceiling fans help circulate the air in a room, ceiling fans also function as decorative items. It is also common to find the lights which illuminate the room incorporated into the ceiling fan. Such lights are usually suspended below the central hub of the ceiling fan. It is also common practice to provide the ceiling fan with separate pull-cord or pull-chain switches for independently switching the fan and the lights on and off. The pull-switch for the fan also allows the rotational speed of the fan to be varied. More recently, ceiling fans having illumination sources which rotate with the fan blades have been introduced. Ceiling fans with rotating illumination sources have the added benefit of providing an aesthetically pleasing visual effect. Examples of ceiling fans having illumination sources which rotate with the fan blades can be found among the references cited below.

U.S. Pat. No. 3,174,552, issued to Armand J. Soucy, Jr. on Mar. 23, 1965, shows a rotor having lighted tips for a rotary wing aircraft. An integral air turbine is provided at the tip of each rotor blade to power the lights at the tip of each rotor blade. A remote control system allows a user to cause the lights at the ends of the rotor blades to flash in a variety of patterns.

U.S. Pat. No. 3,701,498, issued to Peter B. Ferrara on Oct. 31, 1972, and U.S. Pat. No. 3,723,722, issued to Theodore J. Van Iderstine et al. on Mar. 27, 1973, show lighting systems for helicopter rotor blades which use a light source and fiber optics to transmit light to lenses at the tips of the rotor blades.

U.S. Pat. No. 5,028,206, issued to David S. Kendregan et al. on Jul. 2, 1991, shows a ceiling fan with lighted blades. The fan blades of Kendregan et al. are bordered by neon lights which are connected in series. Current to the blade lights is supplied using brushes.

U.S. Pat. No. 5,072,341, issued to Ming-Chien Huang on Dec. 10, 1991, shows a ceiling fan with lights that rotate with the fan blades. Huang does not provide any detail as to how current is supplied to the rotating lights from the stationary house current source.

U.S. Pat. No. 5,082,422, issued to Sui-Mu Wang on Jan. 21, 1992, shows a ceiling fan with arrays of light emitting diodes embedded in the fan blades. Wang uses carbon brushes to supply electric current to the rotating illuminated panels.

U.S. Pat. No. 5,437,540, issued to Blane T. Blocker et al. on Aug. 1, 1995, shows a ceiling fan with neon lights that rotate with the fan blades. The Blocker et al. device uses brushes to supply electric current to the rotating neon lights.

None of the above inventions and patents, taken either singly or in combination, is seen to describe the instant invention as claimed. In particular, none of the references cited above teach or suggest the unique electrical connections and drive mechanism used in the present invention or the particular arrangement of lights used on the fan blades of the present invention.

SUMMARY OF THE INVENTION

The present invention is directed to a ceiling fan having illumination sources that are mounted to the fan blades. Each fan blade has a lighting strip with a plurality of light sources along its length provided along the midline of each blade. Two sets of concentric bearing races, each set of races having a plurality of conductive ball or roller bearings therebetween, provide the conductive connection between the rotating illumination sources and the stationary electrical power supply wires. Each set of bearing races includes an inner stationary race and an outer rotating race. The lights attached to the fan blades are connected in parallel to the outer rotating races. Separate switches control the fan and lighting functions.

Accordingly, it is a principal object of the invention to provide a ceiling fan having illumination sources that are mounted to the fan blades.

It is another object of the invention to provide a ceiling fan which does not rely on brushes to supply electric current to the illumination sources that are mounted to the fan blades.

It is a further object of the invention to provide a ceiling fan which uses two sets of concentric bearing races to supply electric current to the illumination sources that are mounted to the fan blades.

Still another object of the invention is to provide a ceiling fan with lighted fan blades in which an insulating outer housing, which rotates with the fan blades, supports the outer rotating bearing races of the two sets of concentric bearing races used for supplying electric current to illumination sources mounted to the fan blades.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
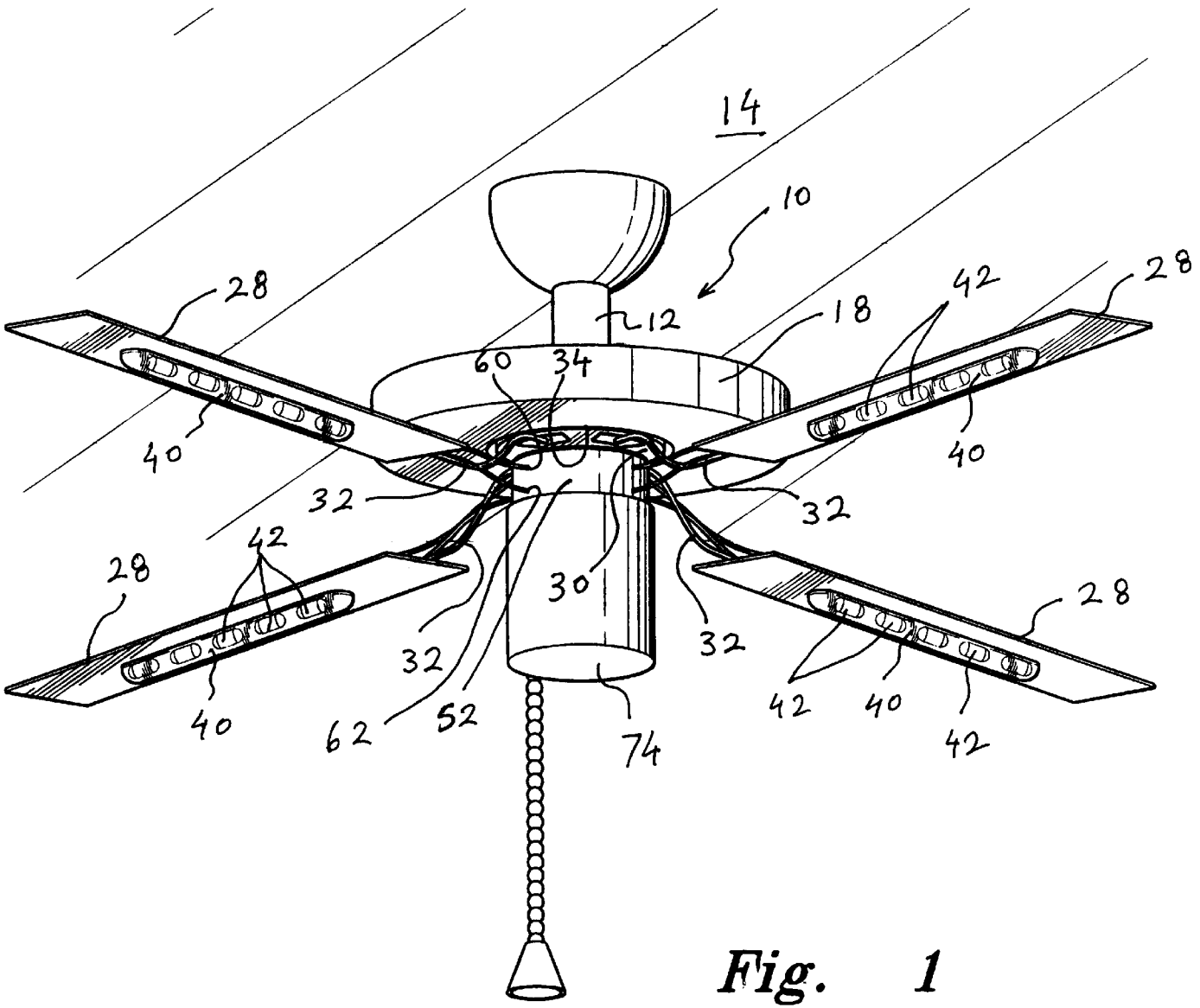
FIG. 1 is an environmental view of a ceiling fan with lighted blades made according to the present invention.
Figure 2:
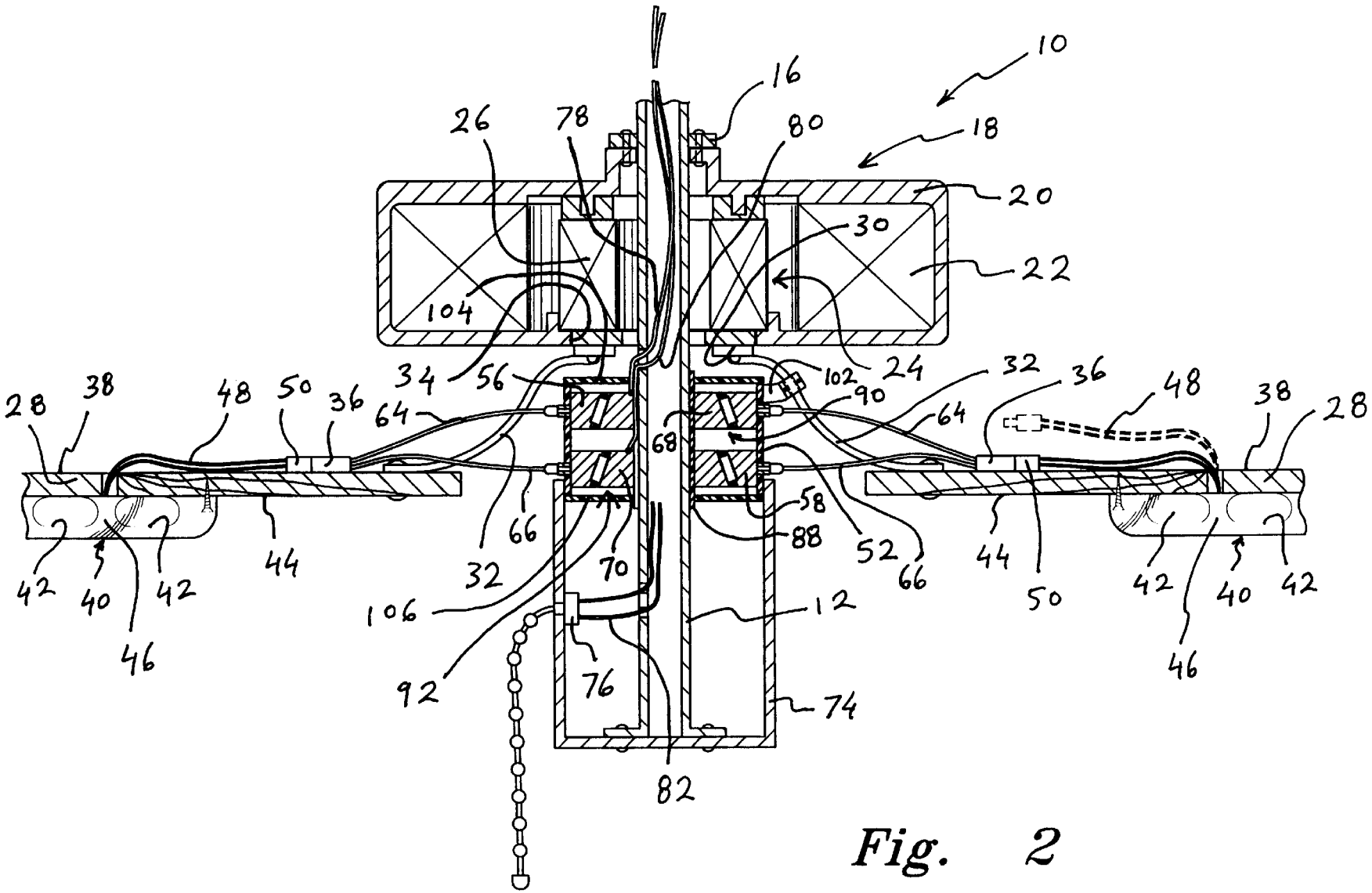
FIG. 2 is a cross sectional view of a ceiling fan with lighted blades made according to the present invention.
Figure 3:
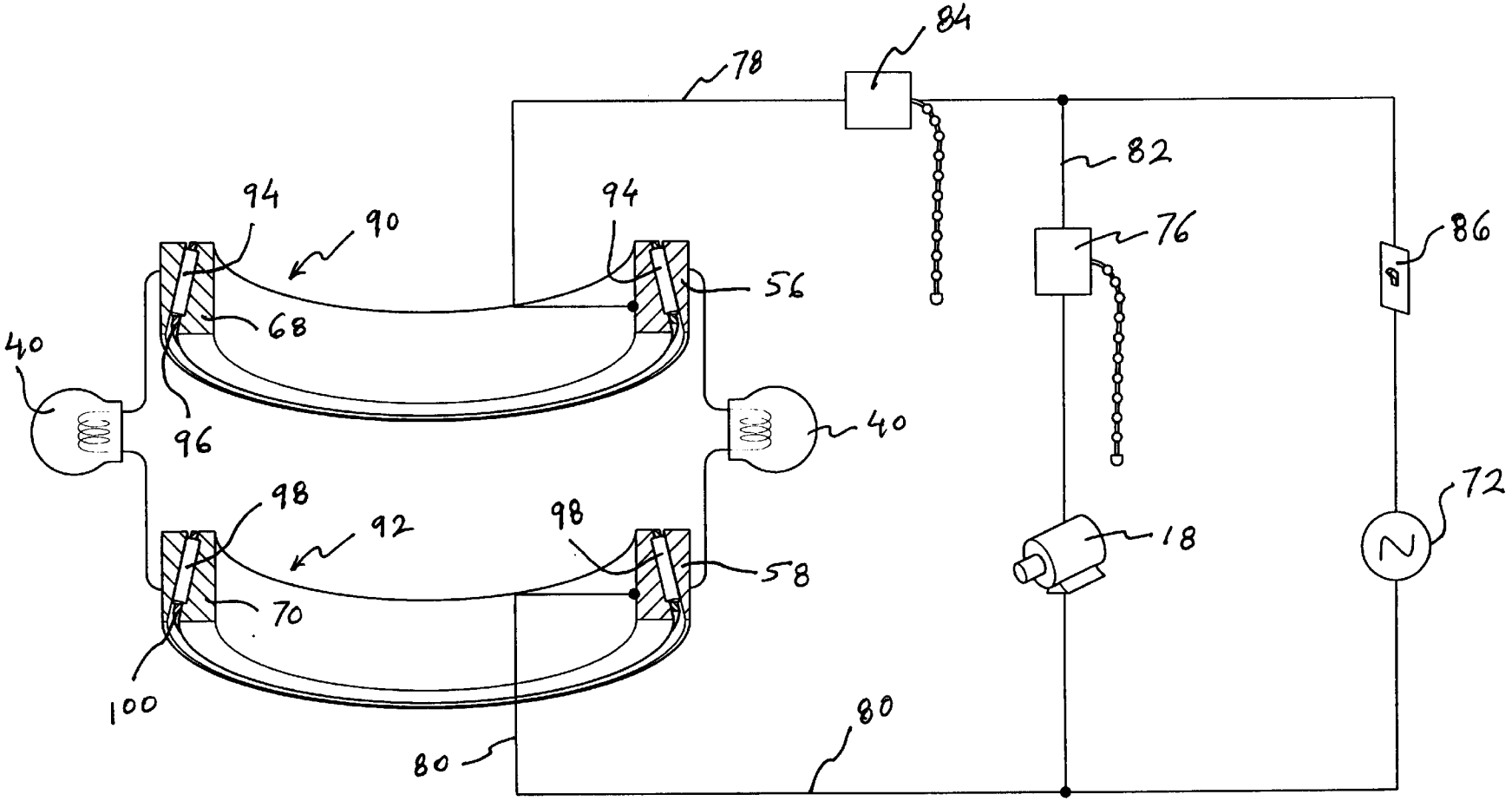
FIG. 3 is a schematic diagram of the wiring in a ceiling fan with lighted blades made according to the present invention.

Referring to FIGS. 1–3, the present invention is directed to a ceiling fan 10 which has lights attached to its blades. The ceiling fan 10 has a fixed central support shaft 12 which is attached to the ceiling 14 at the shaft's upper end in any well known manner. The shaft 12 has a hollow bore. An upper flange 16 fixedly supports an electric motor 18 about the shaft 12.

The electric motor 18 includes a housing 20, a stator coil or windings 22, and a rotor 24 having rotor coils 26. The housing 20 is fixedly attached to the flange 16 which in turn is fixed to the shaft 12. The housing 20 houses the stator windings 22 and the rotor 24. The bottom of the housing 20 has a large circular opening 34, larger in diameter than the inner diameter of the rotor 24, that allows the annular bottom surface 30 of the rotor 24 to be exposed and accessible.

The rotor 24 forms a sleeve around the shaft 12 and is rotatably supported by bearings attached to either the housing 20 or the shaft 12. When the windings 22 and 26 are properly energized, the rotor 24 is set into rotational motion about the shaft 12 with the rotor's axis of rotation being coincident with the longitudinal axis of the shaft 12. Electric motors such as motor 18 are well known and will not be discussed here in any detail.

The ceiling fan 10 has a plurality of fan blades 28. Four fan blades 28 are shown in the example illustrated in the accompanying drawings. Each fan blade 28 is in the form of a thin, flat board or paddle. Each fan blade 28 is fixedly attached to the annular bottom surface 30 of the rotor 24 by a respective one of a plurality of stems 32. One end of each stem 32 is bolted, riveted, or otherwise fixed to the end, closest to the axis of rotation of the rotor 24, of a respective one of the fan blades 28. The other end of each stem 32 is bolted, riveted, or otherwise fixed to the annular bottom surface 30 of the rotor 24. Each stem 32 has an ogee shape with the end attached to the rotor 24 being higher than the end which is attached to the fan blade 28.

With the blades 28 being fixedly connected to the rotor 24, rotation of the rotor 24 will cause the fan blades 28 to rotate about the longitudinal axis of the shaft 12. Therefore, energizing the motor 18 causes the rotation of the fan blades 28. The chordwise dimension of the fan blades 28 is angled relative to the plane of rotation of the fan blades such that the fan blades 28 will act to circulate the surrounding air.

Electric sockets 36 are attached to the back side 38 of each blade 28. A lighting strip 40 including a plurality of illumination sources 42 is screwed to the underside 44 of each, blade 28. The illumination sources 42 may be bulbs, light emitting diodes, etc. The illumination sources 42 are encased in a transparent casing 46 to form the lighting strips 40. The power cord 48 from each lighting strip 40 communicates with a plug 50 which is plugged or inserted into the socket 36. The power cord 48 from each lighting strip 40 is routed to the backside of its respective fan blade 28 by being placed through a hole extending through the thickness of the respective fan blade 28.

An insulating outer cylindrical sleeve 52 houses two sets of roller bearings 90 and 92. Coaxial with the outer cylindrical sleeve 52, is an inner slotted cylindrical sleeve 88 which is frictionally engaged to the shaft 12. The inner sleeve 88 is also made of electrically insulating material. The upper set of roller bearings 90 includes an inner race 68 and an outer race 56. The upper set of roller bearings 90 further includes a plurality of rollers 94 provided intermediate the inner and outer races 68 and 56. The rollers 94 are caged in rectangular slots cut in a thin beveled ring which forms the upper bearing cage 96. The rollers 94 are free to rotate about their longitudinal axes and provide for a very low frictional resistance to relative rotation between the inner and outer races 68 and 56. The inner and outer races 68 and 56, the cage 96, and the rollers 94 are made of materials that conduct electricity, steel being an example of such materials. At least some of the rollers 94 are in contact with both the inner and outer races 68 and 56 at any given instant of time, such that electricity can be conducted between the inner and outer races 68 and 56.

The lower set of roller bearings 92 includes an inner race 70 and an outer race 58. The lower set of roller bearings 92 further includes a plurality of rollers 98 provided intermediate the inner and outer races 70 and 58. The rollers 98 are caged in rectangular slots cut in a thin beveled ring which forms the upper bearing cage 100. The rollers 98 are free to rotate about their longitudinal axes and provide for a very low frictional resistance to relative rotation between the inner and outer races 70 and 58. The inner and outer races 70 and 58, the cage 100, and the rollers 98 are made of materials that conduct electricity, steel being an example of such materials. At least some of the rollers 98 are in contact with both the inner and outer races 70 and 58 at any given instant of time, such that electricity can be conducted between the inner and outer races 70 and 58.

The bearing surfaces of the inner and outer races 68 and 56, on which the rollers 94 roll, are bevelled such that the upper ends of the rollers 94 are closer to the longitudinal axis of the shaft 12 as compared to the lower ends of the rollers 94. Similarly, the bearing surfaces of the inner and outer races 70 and 58, on which the rollers 98 roll, are bevelled such that the upper ends of the rollers 98 are closer to the longitudinal axis of the shaft 12 as compared to the lower ends of the rollers 98. This arrangement allows the inner races 68 and 70 to more efficiently bear the weight of the rollers 94 and 98, the outer races 56 and 58, and the outer sleeve 52.

Alternatively, the surfaces on which the rollers 94 and 98 roll may be recessed so as to prevent axial movement of the bearing races relative to one another. With the bearing surfaces of the races recessed, the roller bearing sets 90 and 92 may be oriented in the direction opposite to that shown in FIGS. 2 and 3 in view of the relatively low weight of the rollers 94 and 98, the outer races 56 and 58, and the outer sleeve 52. In such a case, the lower ends of the rollers 94 and 98 would be closer to the longitudinal axis of the shaft 12 as compared to the upper ends of the rollers 94 and 98. Also, because the total weight of the ball bearings, the outer races, and the outer sleeve 52 would not be very large, ordinary ball bearings may suffice for allowing low friction relative rotation between the inner and outer bearing races.

The insulating outer sleeve 52 has two sets of holes 60 and 62. The first set of holes 60 register with the outer race 56 and the second set of holes 62 register with the outer race 58. The sets of holes 60 and 62 are evenly distributed about their respective outer races 56 and 58, and there is a pair of holes 60 and 62 for each lighting strip 40. Each hole 60 allows a respective lead 64 from a respective socket 36 to electrically communicate with the outer race 56. In the illustrated example, single hole sockets project through each hole 60 and each single hole socket is engaged by a single prong plug connected to a respective lead 64 in order to electrically connect each lead 64 to the outer race 56. The leads 64 may also be electrically connected to the outer race 56 by simply soldering each lead 64 to the outer race 56. Each hole 62 allows a respective lead 66 from a respective socket 36 to electrically communicate with the outer race 58. In the illustrated example, single hole sockets project through each hole 62 and each single hole socket is engaged by a single prong plug connected to a respective lead 66 in order to electrically connect each lead 66 to the outer race 58. The leads 66 may also be electrically connected to the outer race 58 by simply soldering each lead 66 to the outer race 58. In the illustrated example, the outer race 58 serves as a ground connection while the other outer race 56 serves as the hot connection for the sockets 36.

The inner races 68 and 70 are frictionally engaged to the to the inner sleeve 88 which is in turn frictionally engaged to the shaft 12. Thus the inner races 68 and 70 are fixed to the shaft 12. The inner races 68 and 70 are concentric and in registry with the outer races 56 and 58, respectively. As already mentioned, the inner races 68 and 70 are in electrical communication with the outer races 56 and 58, respectively, but the races 68 and 70 are insulated from the shaft 12.

Because of the low frictional resistance to the rotation of the outer races 56 and 58, and therefore to the rotation of the outer sleeve 52 to which the outer races are fixed, the mechanical strength of the leads 64 and 66, and of their connections to the outer races 56 and 58, will be sufficient to rotate the outer races 56 and 58 and the outer sleeve 52 as the blades 28 rotate. Optionally, the sleeve 52 may be mechanically linked to the rotor 24 or to the blade stems 32 to provide a more positive mechanical linkage between the sleeve 52 and the rotor 24. In the illustrated example, a projecting arm 102 is clamped by a U-bracket to one of the blade stems 32. The arm 102 is fixed to the sleeve 52 and therefore causes the sleeve 52 to rotate with the fan blades 28. The outer races 56 and 58, being fixed to the interior of the insulating sleeve 52, also rotate with the insulating housing 52 as the fan blades 28 rotate. The inner races 68 and 70 remain stationary and allow the house current from the house electrical supply source 72 to be connected to the bearing sets 90 and 92 and to ultimately be supplied to the rotating lighting strips 40. Annular caps 104 and 106 cover the open ends of the outer sleeve 52 and prevent foreign objects and dirt from fouling the bearing sets 90 and 92.

A decorative hub cover 74 is fixed to the lower end of the shaft 12. The hub cover 74 supports the pull-cord switch 76 as shown in FIG. 2. The hub cover 74 leaves the holes 60 and 62 exposed so that the hub cover 74 will not interfere with the connection of the wires 64 and 66 to the races 56 and 58 or with the rotation of the insulating sleeve 52.

As was previously stated, the shaft 12 is hollow and allows the house electrical supply wires 78 and 80 to reach the inner races 68 and 70. In the illustrated example, the wires 78 and 80 pass through a hole in the wall of the shaft 12. The wire 78 is then connected to the inner race 68, for example by soldering. The wire 80 is routed through the slot in the inner sleeve 88. The slot in the inner sleeve 88 allows the wire 80 to pass between the inner race 68 and the outer surface of the shaft 12. The wire 80 is then connected to the inner race 70, for example by soldering. The wires 78 and 80 are insulated up to the point at which they contact the inner races 68 and 70, respectively. Alternatively, each of the wires 78 and 80 may pass through respective holes in the wall of the shaft 12 and in the inner sleeve 88 which are in registry with a respective one of the inner races 68 and 70.

In the illustrated example, the inner race 70 is connected to the ground wire 80 and the inner race 68 is connected to the hot wire 78. The hollow shaft 12 also allows the wire 82, supplying power to the motor 18, to be routed through the pull-cord switch 76. Again, other holes in the wall of the shaft 12 allow the wire 82 to be routed to the pull-cord switch 76. Pull-cord switch 76 is of the multi-position variety and can be used for varying the fan speed as well as for turning the fan off and on. A second optional pull-cord switch 84 of the on/off variety can be supported by the hub cover 74 in the same manner as the pull-cord switch 76. The pull-cord switch 84 allows the lighting strips 40 to be turned on and off independent of the fan motor 18 when the wall mounted switch 86 is in the on position. Again, the hollow bore of the shaft 12 can be used to route the hot wire 78 supplying the inner race 68 through the pull-cord switch 84.

It is to be understood that the present invention is not limited to the sole embodiment described above, but encompasses any and all embodiments within the scope of the following claims.

I claim:

1. A ceiling fan having lighted fan blades, the ceiling fan comprising:

a central support shaft capable of being suspended from a ceiling, said central support shaft having a hollow bore;

an electric motor supported by said central support shaft, said electric motor having a rotor disposed coaxially with said central support shaft and said rotor rotating about said central support shaft when said electric motor is energized;

a plurality of fan blades attached to said rotor;

a plurality of illumination means each being fixed to a respective one of said plurality of fan blades;

a first conductive bearing set having a first inner race, a first outer race, and a first plurality of rolling bodies positioned intermediate said first inner race and said first outer race to reduce frictional resistance to relative rotation between said first inner race and said first outer race, said first inner race being positioned to surround said central support shaft and being fixed relative to said central support shaft, said first inner race, said first outer race and said first plurality of rolling bodies being made of electrically conductive material; and a second conductive bearing set having a second inner race, a second outer race, and a second plurality of rolling bodies positioned intermediate said second inner race and said second outer race to reduce frictional resistance to relative rotation between said second inner race and said second outer race, said second inner race being positioned to surround said central support shaft and being fixed relative to said central support shaft, said second inner race being spaced apart from said first inner race, said second inner race, said second outer race and said second plurality of rolling bodies being made of electrically conductive material, said plurality of illumination means being in electrical communication with said first and second outer races while said first and second inner races are in selective electrical communication with a power source, whereby said plurality of illumination means can be lighted as said plurality of fan blades rotate.

2. The ceiling fan according to claim 1, wherein said first plurality of rolling bodies are a first plurality of roller bearings and said second plurality of rolling bodies are a second plurality of roller bearings.

3. The ceiling fan according to claim 2, wherein said first inner race has a first beveled bearing surface upon which said first plurality of roller bearings roll due to relative rotation between said first inner race and said first outer race, and wherein said second inner race has a second beveled bearing surface upon which said second plurality of roller bearings roll due to relative rotation between said second inner race and said second outer race.

4. The ceiling fan according to claim 3, the ceiling fan further comprising:

an insulating inner sleeve surrounding said central support shaft, said insulating inner sleeve being positioned intermediate each of said first and second inner races and said central support shaft.

5. The ceiling fan according to claim 3, the ceiling fan further comprising:

an insulating outer sleeve surrounding said first and second outer races, said first and second outer races being fixed to said insulating outer sleeve.

6. The ceiling fan according to claim 2, wherein said first inner race has a first beveled bearing surface upon which said first plurality of roller bearings roll due to relative rotation between said first inner race and said first outer race, said first beveled bearing surface having a diameter which increases with increasing distance from the ceiling when said central support shaft is positioned to extend vertically below the ceiling, and wherein said second inner race has a second beveled bearing surface upon which said second plurality of roller bearings roll due to relative rotation between said second inner race and said second outer race, said second beveled bearing surface having a diameter which increases with increasing distance from the ceiling when said central support shaft is positioned to extend vertically below the ceiling.

7. The ceiling fan according to claim 6, the ceiling fan further comprising:

an insulating inner sleeve surrounding said central support shaft, said insulating inner sleeve being positioned intermediate each of said first and second inner races and said central support shaft.

8. The ceiling fan according to claim 6, the ceiling fan further comprising:

an insulating outer sleeve surrounding said first and second outer races, said first and second outer races being fixed to said insulating outer sleeve.

9. The ceiling fan according to claim 1, wherein said first plurality of rolling bodies are a first plurality of ball bearings and said second plurality of rolling bodies are a second plurality of ball bearings.

* * * * *